United States Patent [19]

Wittig

[11] Patent Number: 4,813,190

[45] Date of Patent: Mar. 21, 1989

[54] DUAL POSITION EAVES TROUGH

[76] Inventor: Alfred T. Wittig, 2021 Valmont Ave., Eau Claire, Wis. 54701

[21] Appl. No.: 147,506

[22] Filed: Jan. 25, 1988

Related U.S. Application Data

[63] Continuation-in-part of Ser. No. 88,645, Aug. 24, 1987, abandoned.

[51] Int. Cl.[4] ..... E04D 13/00

[52] U.S. Cl. ..... 52/11; 248/48.2

[58] Field of Search ..... 52/11; 248/48.1, 48.2; 405/119

[56] References Cited

U.S. PATENT DOCUMENTS

| | | | |
|---|---|---|---|
| 4,199,121 | 4/1980 | LeFebvre | 248/48.2 |
| 4,309,792 | 1/1982 | Faye | 52/11 X |
| 4,446,658 | 5/1984 | Gowin | 52/11 |
| 4,669,232 | 6/1987 | Wyatt | 52/11 |

*Primary Examiner*—Carl D. Friedman

*Attorney, Agent, or Firm*—Robert C. Baker

[57] ABSTRACT

The dual position eaves trough apparatus has a mounting bracket which is L-shaped and has a vertical mounting leg and a horizontal projecting arm united to the mounting leg and extending in spaced relationship underneath the overhang of the roof. The projecting arm has a pivot base hole spaced from its outermost end for pivotably mounting an eaves trough support bar, and has a base lockmate hole spaced from the pivot base hole. An eaves trough support bar has a pivot mount structure, a first lockmate hole spaced from the mount structure, a second lockmate hole also spaced from the mount structure, and an extension portion which extends beyond the mount structure and serves as the support portion for the eaves trough. The eaves trough support bar is pivotably mounted at its pivot mount structure to the pivot base hole of the L-shaped bracket. An eaves trough is mounted to the extension portion of the eaves trough support bar. A lock pin is employed for locking either the first or second lockmate hole to the base lockmate hole for the L-shaped bracket to hold the eaves trough in either an operable or inoperable position.

18 Claims, 3 Drawing Sheets

DUAL POSITION EAVES TROUGH

CROSS REFERENCE TO RELATED APPLICATION

This is a continuation-in-part of my application Ser. No. 088,645, filed Aug. 24, 1987 now abandoned.

BACKGROUND OF THE INVENTION

This invention relates to a novel eaves trough apparatus. The apparatus facilitates cleaning and seasonal storage of the eaves trough. The eaves trough itself may be positionally locked at the eaves edge for water collection and alternatively may be pivoted into an inverted position underneath the overhang of the roof for simplified cleaning and winter storage.

Insofar as known, no one has heretofore figured out a way to provide not only a simplified and reliably strong pivotable eaves trough apparatus, as provided by this invention, but also an eaves trough apparatus having a simplified lock system permitting quick shift of the eaves trough between a storage position underneath the roof overhang for winter protection and an operable position at the eaves edge for rain collection. This new eaves trough apparatus also provides the advantage of being useful on a variety of building designs, and whether or not a roof overhang soffit or roof fascia is employed. It may be mounted on an outside building wall as distinct from the usual mounting on the roof overhang or on a soffit or fascia. Alternatively, a design is taught which permits mounting on the underside of a roof overhang.

SUMMARY OF THE INVENTION

The dual position eaves trough apparatus is one wherein the eaves trough is primarily lockable in an upright position at the eaves edge of a roof, and secondarily lockable in an inoperable inverted position underneath the overhang of the roof.

The preferred apparatus comprises an L-shaped bracket formed of a mounting leg and a projecting arm united to the mounting leg. The mounting leg is fixedly attached in vertical orientation to a outside building wall located underneath the overhang of the roof. The projecting arm of the L-shaped bracket extends horizontally in spaced relationship underneath the overhang of the roof. The projecting arm has a pivot base means proximate to its outermost end for pivotably mounting an eaves trough support bar for pivot movement with respect to the projecting arm. The projecting arm also has a base lockmate means spaced inwardly from the pivot base means.

The eaves trough support bar of the preferred apparatus has a first lockmate means proximate to one end, a pivot mount structure spaced from the first lockmate means, a second lockmate means spaced from the pivot mount structure, and an extension portion located beyond the second lockmate means for supporting the eaves trough. The eaves trough support bar is pivotably mounted at its pivot mount structure to the pivot base means of the L-shaped bracket. An eaves trough is mounted on the eaves trough support bar at the extension portion thereof. Optionally, but preferably, a transverse support member is contoured to the shape of the eaves trough bottom and side walls; and this support member is fixed to the extension portion of the eaves trough support bar and to the side walls of the eaves trough to support the eaves trough.

A lock means is provided for locking the first lockmate means of the support bar to the base lockmate means of the L-shaped bracket to thereby hold the eaves trough apparatus in an upright position for collecting rain at the eaves' edge of a roof. The lock means is alternatively adapted to lock the second lockmate means of the support bar to the base lockmate means of the L-shaped bracket to thereby place the eaves trough apparatus in an inoperable inverted position underneath the overhang of the roof.

Alternatively, the apparatus may be constructed with a first and second base lockmate means on the projecting arm and one or possibly more support bar lockmate means on the eaves trough support bar. The first base lockmate means and a single support bar lockmate means may be locked together to hold the eaves trough in an inoperable position underneath the overhang of the roof The second base lockmate means ma be locked to the single support bar lockmate means to hold the eaves trough in an inoperable position underneath the overhang of the roof.

Optionally, the apparatus may include a means to adjust the length of the projecting arm. The apparatus may also include a height adjusting means to adjust the height of the eaves trough support bar. Furthermore, a bracket having a mounting portion and a downwardly depending flange may be mounted to the underside of the overhang of a roof. The downward flange may contain the pivot means for pivotably supporting the eaves trough support bar.

A multitude of additional features and benefits and advantages of the invention will become evident as this description further proceeds.

BRIEF DESCRIPTION OF THE DRAWINGS

FIG. 1 is a perspective view of the dual position eaves trough apparatus with the eaves trough in the outward or operable position for collecting rain;

FIG. 2 is a transverse cross-sectional view of the apparatus with the eaves trough again in the outward or operable working position;

FIG. 3 is a transverse cross-sectional view of the apparatus with the eaves trough in an intermediate position between operable and inoperable;

FIG. 4 is a transverse cross-sectional view of the apparatus with the eaves trough locked in the inoperable inverted storage or cleaning position underneath the roof overhang;

DESCRIPTION OF PREFERRED EMBODIMENTS

The elements making up the preferred eaves trough apparatus of this invention shown in FIGS. 1–4 are given the same numbering. The apparatus of those figures will first be discussed.

The eaves trough 10 is primarily lockable in an upright position at the eaves edge 12 of a roof 15 (FIGS.

Figure 4:
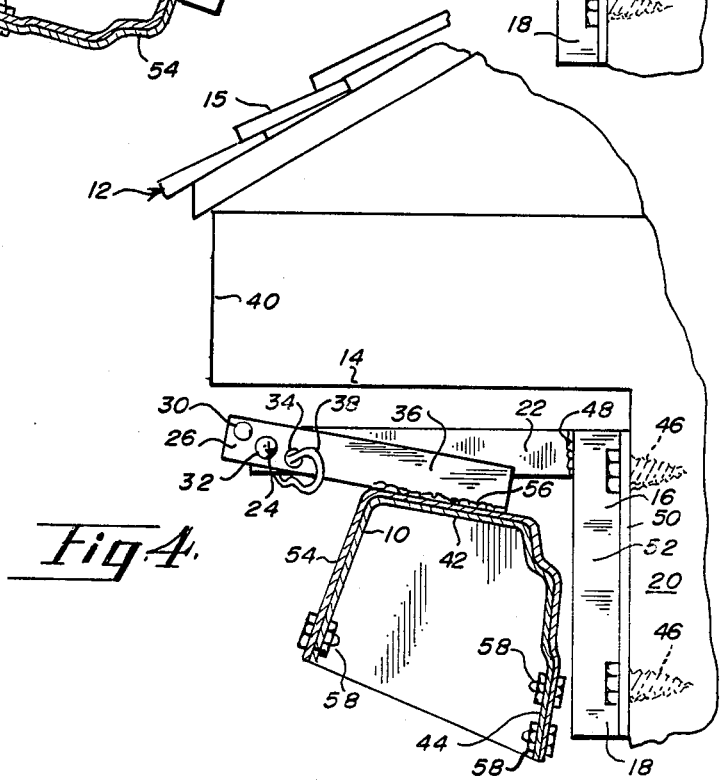

1 and 2). It is secondarily lockable in an inoperable inverted position with the eaves trough 10 underneath the overhang 14 of the roof 15 (FIG. 4).

Figure 1:
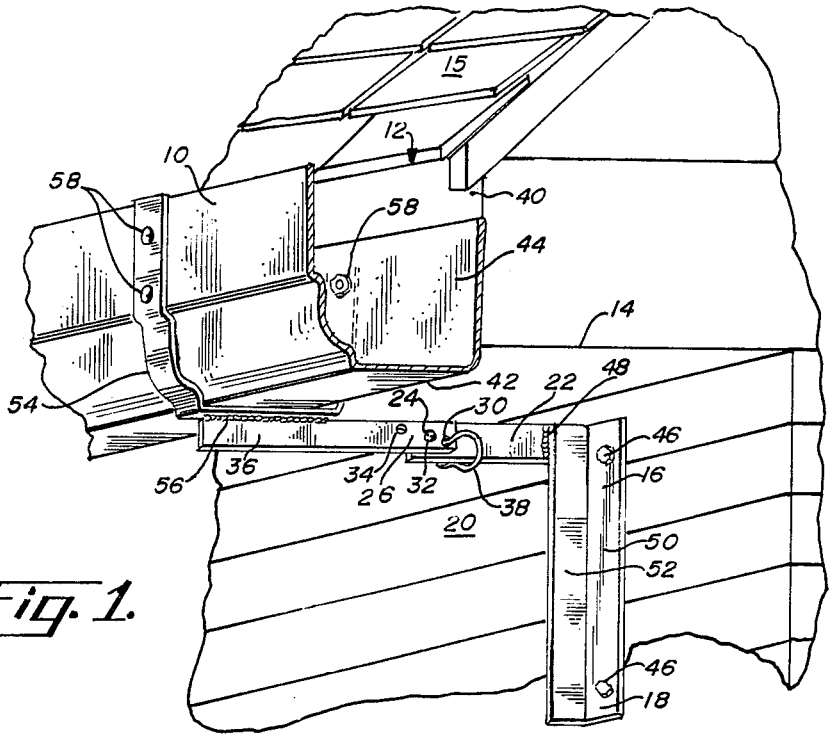
In FIGS. 1–4 of the drawing, a roof overhang and an outer side wall underneath the overhang are schematically shown, with parts broken away.
Figure 2:
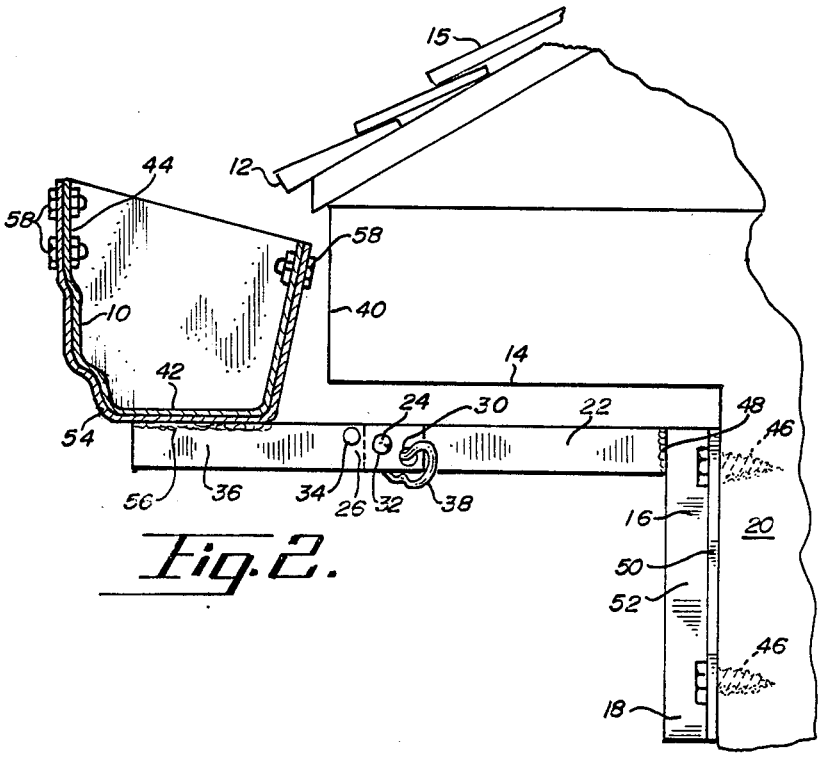
Figure 3:
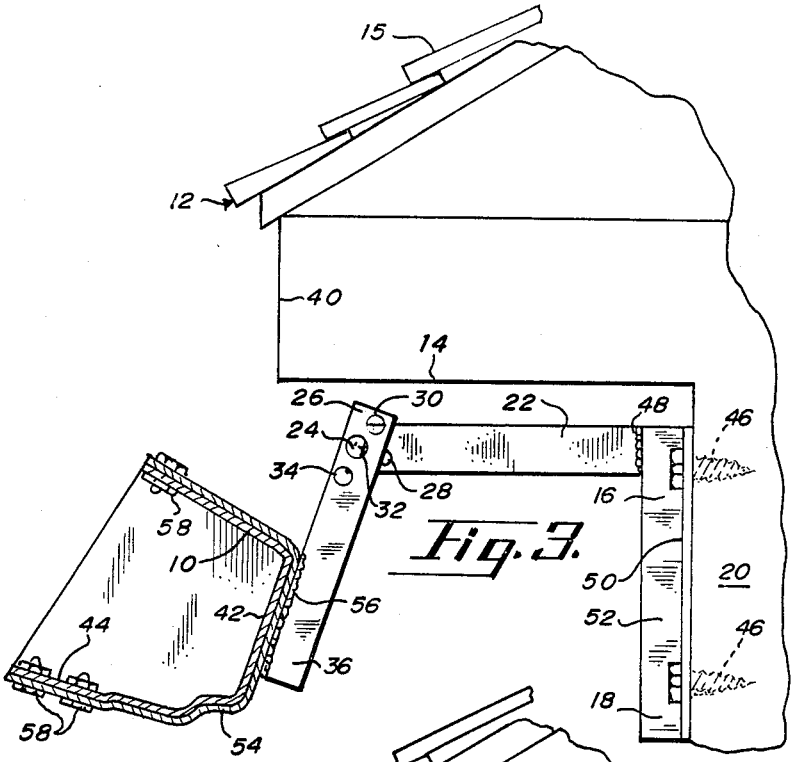

Referring to FIG. 1, the L-shaped bracket 16 of the apparatus has a mounting leg 18 for fixed attachment in vertical orientation to an outside building wall 20 located underneath the overhang 14 of the roof 15. The L-shaped bracket 16 also has a projecting arm 22 fixedly united to the mounting leg 18 and extending horizontally in space relationship underneath the overhang 14 of the roof 15. The projecting arm 22 has a pivot base means 24 proximate to its outermost end for pivotably mounting an eaves trough support bar 26 for pivot movement with respect to the projecting arm 22. The projecting arm 22 also has a base lockmate means 28 (best shown in FIG. 3) spaced inwardly from the pivot base means 24.

The eaves trough support bar 26 of the apparatus has a first lockmate means 30 proximate to one end. Next, it has a pivot mount structure 32 spaced from the first lockmate means 30. Then it has a second lockmate means 34 spaced from the pivot mount structure 32. Finally, it has an extension portion 36 located beyond the second lockmate means 34; and this extension portion is for supporting an eaves trough 10. The eaves trough support bar 26 is pivotably mounted at its pivot mount structure 32 to the pivot base means 24 of the L-shaped bracket 16 by means of a bolt, rivet, or any other shafted connector means permitting pivot movement of the support bar with respect to the projecting arm 22 of the L-shaped bracket. The eaves trough 10 is fixed to the extension portion 36 of the eaves trough support bar 26.

A lock means 38 locks the first lockmate means 30 to the base lockmate means 28 of the L-shaped bracket 16 and places the eaves trough 10 in an upright position for collecting rain. The lock means alternatively is adapted to lock the second lockmate means 34 to the base lockmate means 28 of the L-shaped bracket 16 and to thereby place the eaves trough 10 in an inoperable inverted position underneath the overhang 14 of the roof 15.

Preferably, the eaves trough 10 is located underneath the eaves edge 12 of the roof 15 and adjacent the roof fascia 40, with the L-shaped bracket and the eaves trough support bar 24 extending underneath an overhang soffit 14 of the roof 15. However, this apparatus is useful and operable for structures lacking a soffit 14 or a roof fascia 40. Neither a soffit nor a fascia is required for mounting the apparatus.

The eaves trough 10 preferably has a bottom wall 42 and two generally vertical side walls 44. However, the eaves trough 10 may be constructed in a variety of different contours or configurations, including a V-shape or semi-circular shape.

The L-shaped bracket 16 is attached by means of suitable bracket fasteners 46 to the outside building wall 20. The mounting leg 18 is constructed of an angle iron having a mounting leg base plate 50 and a mounting leg projecting plate 52. The projecting arm 22 of the L-shaped bracket 16 is fixed to the mounting leg projection plate 52 of the mounting leg 18 by a weld line 48 or any other suitable means.

In the preferred embodiment, a transverse support member 54 is used to fix the eave trough 10 to the extension portion 36 of the eaves trough support bar 26. Usually the eaves trough 10 will be comprised of side walls 44 and a bottom wall 42; and the support member 54 is formed or contoured to the shape of the eaves trough bottom wall 42 and the side walls 44. The support member 54 is fixed to the projection 36 of the eaves trough support bar 26 by any suitable means 56 such as a weld or rivet or bolt. The support member 54 is then fixed to the eaves trough side walls 44 by fasteners 58 (e.g., welds or rivets or bolts). The fasteners 58 are connected to the eaves trough 10 through the eaves trough side walls 44 (and not the bottom) so as to obviate leakage caused by imperfect bolting or riveting if such were to extend through the eaves trough bottom wall 42.

The base lockmate mean 28 preferably consists of a hole through the projecting arm 22, as do the first lockmate means 30 and second lockmate means 34. A pin member suitably is used as the lockmate means 38. The pin member is inserted through the hole through the projecting arm 22 and a selected hole through the eaves trough support bar 26 to lock the eaves trough 10 in the desired locking position. Optionally, the base lockmate means 28 may be comprised of detent means or a hemispherically shaped outward projection, and the first lockmate means 30 and the second lockmate means 34 may be comprised of holes which lock with the hemispherically shaped outward projection when the eaves trough support bar is pivoted to the desired locking position.

Figure 5:
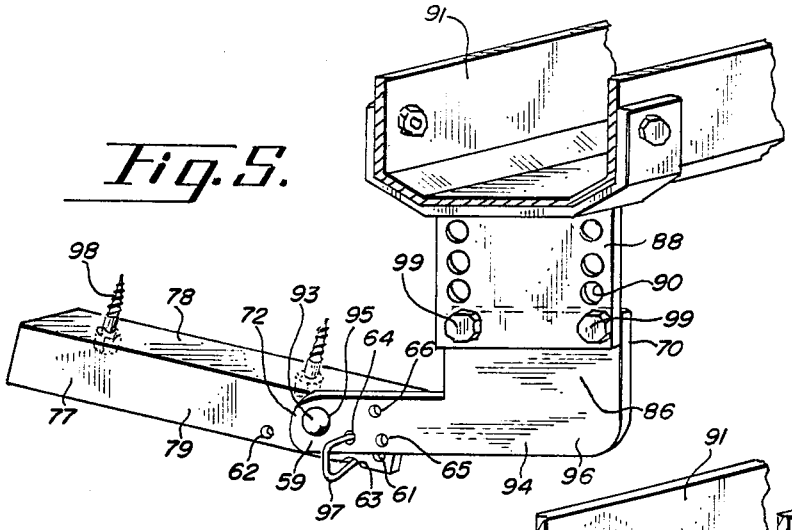
FIG. 5 is a perspective view of an alternative form of the apparatus of the invention having an adjustable height means and a bracket for mounting on the underside of a roof overhang.

The embodiment of FIG. 5 is designed for mounting the invention underneath the overhang of a roof, including under overhang soffits that are sloped and not horizontal. Bracket 77 is constructed of an angle iron having a mounting portion 78 and a flange portion 79. The mounting portion 78 includes holes to receive bracket fasteners or screw 98 which fix the mounting portion 78 to the underside of a sloped roof overhang. The flange portion 79 depends downwardly from the mounting portion 78 and is comparable to the projecting arm part of the bracket of FIGS. 1–4. The flange portion 79 illustratively includes a pivot base means 93, and two lockmate means, discussed below.

The eaves trough support bar 94 in FIG. 5 has a stub bar portion 59 and an extension portion 96. The stub bar portion 59 has at leas one support bar lockmate means and may have more, as illustrated, two are showing, namely a first support bar lockmate means 64 and a second support bar lockmate means 66. Both are spaced outwardly from a pivot mount structure 95. (Also showing is an optional third or alternative "first" support bar lockmate means 65 explained below.)

The flange portion 79 of bracket 77 is constructed with a first base lockmate means which is not seen in FIG. 5 and a second base lockmate means 62. The first base lockmate means in FIG. 5 is located directly behind the first support bar lockmate means 64. The first base lockmate means is spaced outwardly (i.e., toward the end of the flange portion 79) from the pivot base means 93; and the second base lockmate means 62 is spaced inwardly (i.e., in a direction away from the outer end of the flange portion 79) from the pivot base means 93. The first base lockmate means and second base lockmate means 62 consist of holes drilled through the flange portion 79.

The upper arm or part of a U-shaped spring pin serves as a lock means 97 to hold the eaves trough 91 in position. The hole of the first support bar lockmate means 64 is locked with the spring pin to the hole of the first base lockmate means of the flange 79 to hold the eaves trough 91 in an upright position for collecting rain. The first support bar lockmate means 64 may be locked to the first base lockmate means in a manner causing the eaves trough support bar 94 to be non-aligned with the longitudinal direction of the flange portion 79 of the bracket 77. This depends on the exact position of the respective lockmate holes. A recess 63 in the flange portion 79 is added for the non-alignment locking to provide sufficient clearance for the use of a standard sized spring pin for the illustrated location of the lockmate holes.

An alternative first support bar lockmate means 65 may be located to lock to an alternative first base lockmate means 61 in a manner causing the eaves trough support bar 94 to be aligned with the longitudinal direction of the flange portion 79.

The hole 66 forming the second support bar lockmate means may be locked with a spring pin to the hole of the second base lockmate means 62 to hold the eaves trough 91 in an inoperable inverted position underneath the overhang of the roof. (It will be appreciated, however, that a single support bar lockmate hole medially located between the upper and lower edges of the support bar stub portion 59 may replace the several support bar lockmate holes illustrated in FIG. 5, and locked as by a bolt pin to a medially located outward first base lockmate hole to support the eaves trough at the eaves edge of a roof or to a medially located inward second base lockmate hole for under eaves storage of the eaves trough.)

The end 72 of the eaves trough support bar 94 which attaches to the flange portion 79 of bracket 77 is suitably rounded in a vertical plane to provide for unobstructed rotation of the eaves trough support bar 94 even when the pivot connection 95 is very close to the underside of the roof overhang.

Also illustrated in FIG. 5 is height adjusting means 70 interposed between the extension portion 96 of the eaves trough support bar 94 and the eaves trough 91. This enables the space between the eaves trough 91 and the extension portion 96 to be adjusted. The height adjusting means 70 consists of a first plate 86 fixed on the extension portion 96 and a second plate 88 united to the eaves trough assembly. Bolts 99 pass through space holes in the first plate 86 and then through any selected pairs of holes in the columns of adjustment holes 90 of the second plate 88 for achieving different spacing of the eaves trough from the extension portion 96 and thereby adjust the height of the eaves trough.

Figure 6:
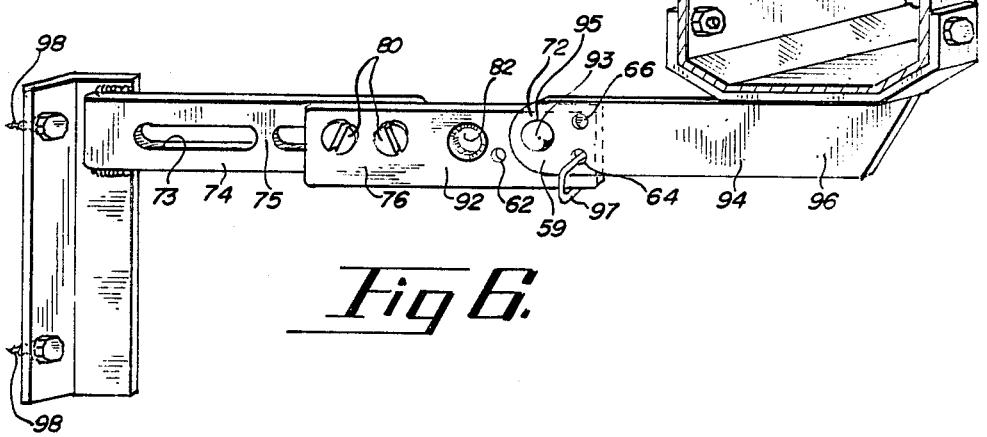
FIG. 6 is a perspective view of a further alternative form of the apparatus of the invention and illustrates a slidably adjustable length means for the projecting arm of the mounting bracket.

Referring now to FIG. 6, a length adjusting means may be employed to adjust the horizontal distance between an eaves trough and the mounting of any bracket. The length adjusting means for a projecting arm 92 is suitably constructed of a first arm member 74 and a second arm member 76. The first arm member 74 illustratively includes a lengthwise groove means 73 with an intermediate strengthening bridge 75, if desired. The second arm member 76 is longitudinally slidable with respect to the first arm member 74. The second arm member 76 is slid to the desired length and tapered fasteners 80 are used to lock the arm members of the length adjusting means to the desired length.

The tapered fasteners 80 are recessed into tapered fastener holes 82 on the lateral side of the second arm member 76 to which the eaves trough support bar 94 is pivotably attached. The eaves trough support bar 94 is pivotably fixed to the lateral side surface of the second arm member 76 of the projecting arm 92 which is opposite the side of the second arm member 76 which is slidable against the first arm member 74. The tapered fastener holes 82 receive tapered fasteners 80 having ends which become flush with the exterior surface of the second arm member 7 so that the eaves trough support bar 94 may be pivoted in a manner flush against or immediately adjacent that surface of the second arm member 76 without interference as might be caused by a projecting nut o projecting bolt head.

It should be appreciated that features of different Figures of the drawing may be incorporated in the structure of other Figures without departing from the teaching of the invention, and that the invention may be embodied in other specific forms than illustrated without departing from the spirit or essential characteristics thereof. The illustrated embodiments are therefore to be considered in all respects as illustrative and not restrictive, the scope of the invention being indicated by the appended claims rather than by the foregoing description; and all changes which come within the meaning and range of equivalency of the claims are therefore intended to be embraced thereby.

That which is claimed is:

1. A dual position eaves trough apparatus wherein the eaves trough is primarily lockable in an upright position at the eaves edge of a roof and is secondarily lockable in an inoperable inverted position underneath the overhang of the roof, comprising:

(a) an L-shaped bracket having a mounting leg for fixed attachment in vertical orientation to an outside building wall located underneath the overhang of the roof, and a projecting arm united to said mounting leg and extending horizontally in spaced relationship underneath the overhang of the roof, said projecting arm having pivot base means proximate to its outermost end for pivotably mounting an eaves trough support bar for pivot movement with respect to said projecting arm and having a base lockmate means spaced inwardly from said pivot base means, (b) an eaves trough support bar having first lockmate means proximate to one end, a pivot mount structure spaced from said first lockmate means, a second lockmate means spaced from said pivot mount structure, and an extension portion located beyond said second lockmate means for supporting an eaves trough, said eaves trough support bar being pivotably mounted at said pivot mount structure to said pivot base means of said L-shaped bracket, (c) an eaves trough mounted to said eaves trough support bar at the extension portion thereof, and (d) a lock means for locking said first lockmate means to said base lockmate means of said L-shaped bracket to thereby hold said eaves trough in an upright position for collecting rain, said lock means alternatively being adapted to lock said second lockmate mans to said base lockmate means of said L-shaped bracket to thereby hold said eaves trough in an inoperable inverted position underneath the overhang of the roof.

2. The apparatus of claim 1, wherein the eaves trough is comprised of a bottom wall and two generally vertical side walls.

3. The apparatus of claim 1, wherein said eaves trough is comprised of side walls and a bottom wall and a support member is formed to the shape of the eaves trough bottom and side walls, said support member being mounted to said eaves trough support bar, and said support member being fixed to said eaves trough solely at upper portions of said side walls thereof.

4. The apparatus of claim 1, wherein the base lockmate means comprises a hole through said projecting arm of said L-shaped bracket, said first lockmate means and said second lockmate means are each comprised of holes through said eaves trough support bar, and wherein said lock means comprises a pin member.

5. The apparatus of claim 1, wherein said projecting arm includes means for adjustment of the length thereof.

6. The apparatus of claim 1, wherein said projecting arm comprises a first arm member and a second arm member longitudinally slidable with respect to said first arm member.

7. The apparatus of claim 1, wherein said eaves trough is mounted to said extension portion of said support bar by means adjustable in height for varying the height of said eaves trough with respect to said extension portion.

8. A dual position eaves trough apparatus wherein the eaves trough is primarily lockable in an upright position at the eaves edge of a roof and is secondarily lockable in an inoperable inverted position underneath the overhang of the roof, comprising:

(a) an L-shaped bracket having a mounting leg for fixed attachment in vertical orientation to an outside building wall located underneath the overhang of the roof, and a projecting arm united to said mounting leg and extending horizontally in spaced relationship underneath the overhang of the roof, said projecting arm having pivot base means located toward its outermost end for pivotably mounting an eaves trough support bar for pivot movement with respect to said projecting arm and having a first base lockmate means spaced outwardly from said pivot base means and a second base lockmate means spaced inwardly from said pivot base means, (b) an eaves trough support bar comprising a stub bar portion and an extension portion, said stub bar portion having a pivot mount structure and having support bar lockmate means spaced from said pivot mount structure, said eaves trough support bar being pivotably mounted at said pivot mount structure thereof to said pivot base means of said L-shaped bracket, (c) an eaves trough mounted to said eaves trough support bar at the extension portion thereof, and (d) a lock means for locking said support bar lockmate means to said first base lockmate means of said L-shaped bracket in a manner to hold said eaves trough in an upright position for collecting rain, said lock means alternatively being adapted to lock said support bar lockmate means to said second base lockmate means of said L-shaped bracket in a manner to hold said eaves trough in an inoperable inverted position underneath the overhang of the roof.

9. The apparatus of claim 8, wherein the end of the stub bar portion extending outwardly from the pivot mount structure thereof is rounded in a vertical plane.

10. The apparatus of claim 8, wherein said projecting arm includes means for adjustment of the length thereof.

11. The apparatus of claim 8, wherein said projecting arm comprises a first arm member and a second arm member longitudinally slidable with respect to said first arm member.

12. The apparatus of claim 8, wherein said eaves trough is mounted to said extension portion of said support bar by means adjustable in height for varying the height of said eaves trough with respect to said extension portion.

13. A dual position eaves trough apparatus wherein the eaves trough is primarily lockable in an upright position at the eaves edge of a roof and is secondarily lockable in an inoperable inverted position underneath the overhang of the roof, comprising:

(a) a bracket having a mounting portion for fixed attachment to the underside of the overhang of a roof and a downwardly depending flange portion united to said mounting portion, said flange portion having pivot base means toward its outermost end most proximate to the eaves edge of a roof for pivotably mounting an eaves trough support bar for pivot movement with respect to said flange portion and having base lockmate means spaced from said pivot base means, (b) an eaves trough support bar comprising a stub bar portion and an extension portion, said stub bar portion having a pivot mount structure, a first support bar lockmate means spaced from said pivot mount structure and a second support bar lockmate means spaced from said pivot mount structure, said eaves trough support bar being pivotably mounted at said pivot mount structure thereof to said pivot base means of said flange portion of said bracket, (c) an eaves trough mounted to said eaves trough support bar at the extension portion thereof, and (d) a lock means for locking said first support bar lockmate means to said base lockmate means of said flange portion to thereby hold said eaves trough in an upright position for collecting rain, said lock means alternatively being adapted to lock said second support bar lockmate means to said base lockmate means of said flange portion to thereby hold said eaves trough in an inoperable inverted position underneath the overhang of the roof.

14. The apparatus of claim 13, wherein said eaves trough is mounted to said extension portion of said support bar by means adjustable in height for varying the height of said eaves trough with respect to said extension portion.

15. The apparatus of claim 13, wherein said first support bar lockmate means is lockable to said base lockmate means of said bracket in a manner causing said eaves trough support bar to be non-aligned with the length direction of said flange portion of said bracket.

16. A dual position eaves trough apparatus wherein the eaves trough is primarily lockable in an upright position at the eaves edge of a roof and is secondarily lockable in an inoperable inverted position underneath the overhang of the roof, comprising:

(a) a bracket having a mounting portion for fixed attachment to the underside of the overhang of a roof and a downwardly depending flange portion united to said mounting portion, said flange portion having pivot base means toward its outermost end most proximate to the eaves edge of a roof for pivotably mounting an eaves trough support bar for pivot movement with respect to said flange portion and having a first base lockmate means spaced outwardly from said pivot base means and a second base lockmate means spaced inwardly from said pivot base means, (b) an eaves trough support bar comprising a stub bar portion and an extension portion, said stub bar portion having a pivot mount structure and having support bar lockmate means spaced from said pivot mount structure, said eaves trough support bar being pivotably mounted at said pivot mount structure thereof to said pivot base means of said flange portion of said bracket, (c) an eaves trough mounted to said eaves trough support bar at the extension portion thereof, and (d) a lock means for locking said support bar lockmate means to said first base lockmate means of said flange portion in a manner to hold said eaves trough in an upright position for collecting rain, said lock means alternatively being adapted to lock said support bar lockmate means to said second base lockmate means of said flange portion in a manner to hold said eaves trough in an inoperable inverted position underneath the overhang of the roof.

17. The apparatus of claim 16, wherein said eaves trough is mounted to said extension portion of said support bar by means adjustable in height for varying the height of said eaves trough with respect to said extension portion.

18. The apparatus of claim 16, wherein said support bar lockmate means is lockable to said first base lockmate means of said bracket in a manner causing said eaves trough support bar to be non-aligned with the length direction of said flange portion of said bracket.

* * * * *